US011101590B2

(12) United States Patent
Miyamura et al.

(10) Patent No.: US 11,101,590 B2
(45) Date of Patent: Aug. 24, 2021

(54) CONNECTOR, JIG AND METHOD FOR ASSEMBLING TERMINAL TO CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tetsuya Miyamura, Mie (JP); Hajime Kawase, Mie (JP); Masaaki Tabata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/754,523

(22) PCT Filed: Oct. 22, 2018

(86) PCT No.: PCT/JP2018/039123
§ 371 (c)(1),
(2) Date: Apr. 8, 2020

(87) PCT Pub. No.: WO2019/082830
PCT Pub. Date: May 2, 2019

(65) Prior Publication Data

US 2020/0274279 A1 Aug. 27, 2020

(30) Foreign Application Priority Data

Oct. 24, 2017 (JP) ..... JP2017-205198

(51) Int. Cl.
*H01R 13/426* (2006.01)
*H01R 43/20* (2006.01)

(52) U.S. Cl.
CPC ..... *H01R 13/426* (2013.01); *H01R 43/20* (2013.01)

(58) Field of Classification Search
CPC ..... H01R 13/426; H01R 13/4361; H01R 13/4362

(Continued)

(56) References Cited

U.S. PATENT DOCUMENTS 4,767,361 A * 8/1988 Hoshino ..... H01R 13/422 439/596
5,355,583 A * 10/1994 Osumi ..... H01R 43/22 29/33 M (Continued)

FOREIGN PATENT DOCUMENTS

JP 06-029082 4/1994
JP 2001-345140 12/2001

(Continued)

OTHER PUBLICATIONS

Official Communication issued in International Bureau of WIPO Patent Application No. PCT/JP2018/039123, dated Dec. 4, 2018.

*Primary Examiner* — Neil Abrams
(74) *Attorney, Agent, or Firm* — Greenblum & Bernstein, P.L.C.

(57) ABSTRACT

A female connector includes an upper retainer and a lower retainer to be mounted into a connector housing and movable along a retainer moving direction intersecting a terminal inserting direction between a partial locking position for allowing insertion of terminals into cavities and a full locking position for locking and retaining the terminals. The upper and lower retainers include upper cam pins and lower cam pins projecting in a pin projecting direction intersecting (Continued)

the retainer moving direction and different from the terminal inserting direction. The upper and lower cam pins are fit into upper cam grooves and lower cam grooves provided in a jig and move in the upper and lower cam grooves, whereby the upper and lower retainers move between the full locking position and the partial locking position.

5 Claims, 12 Drawing Sheets

(58) Field of Classification Search
USPC ..... 439/752; 876/876, 884, 749
See application file for complete search history.

(56) References Cited

U.S. PATENT DOCUMENTS 5,403,213 A * 4/1995 Inaba ..... H01R 13/4362 439/598
5,438,748 A 8/1995 Matsuzawa
6,183,314 B1 * 2/2001 Wada ..... B29C 45/006 439/752
6,264,497 B1 * 7/2001 Murakami ..... H01R 4/2433 439/417
6,435,920 B2 * 8/2002 Kashiyama ..... H01R 13/4362 439/595
7,278,890 B1 * 10/2007 Smutny ..... H01R 13/4361 439/752
7,347,732 B2 * 3/2008 Ohtaka ..... H01R 13/4362 439/595
7,661,999 B2 * 2/2010 Horiuchi ..... H01R 13/506 439/752
8,684,773 B2 * 4/2014 Kobayashi ..... H01R 13/4362 439/752
9,083,114 B2 * 7/2015 Muro ..... H01R 13/4362
10,566,729 B2 * 2/2020 Rangi ..... H01R 43/18
10,615,532 B2 * 4/2020 Miyamura ..... H01R 13/42
2001/0051468 A1 12/2001 Kashiyama et al.
2018/0337491 A1 11/2018 Miyamura et al.
2020/0274279 A1 * 8/2020 Miyamura ..... H01R 13/4362

FOREIGN PATENT DOCUMENTS

JP 2003-051352 2/2003
JP 2015-198004 11/2015
JP 2016-146240 8/2016

* cited by examiner

CONNECTOR, JIG AND METHOD FOR ASSEMBLING TERMINAL TO CONNECTOR

TECHNICAL FIELD

A technique disclosed in this specification relates to a connector with a retainer.

BACKGROUND ART

Conventionally, a connector for accommodating a terminal is known from Japanese Unexamined Patent Publication No. 2003-51352. This connector includes a connector housing formed with a cavity into which the terminal is inserted. A resiliently deformable locking lance is formed to project into the cavity from an inner wall of the cavity. The terminal is connected to an end of a wire.

The connector housing is formed with a retainer insertion opening into which the retainer is inserted and which communicates with the cavity. The retainer is movable between a partial locking position and a full locking position.

With the retainer disposed at the partial locking position, the retainer is retracted from the cavity, so that the terminal and the retainer do not interfere.

If the terminal is inserted into the cavity with the retainer disposed at the partial locking position with respect to the connector housing, the terminal comes into contact with the locking lance. If the terminal is pushed into the cavity, the locking lance is resiliently deformed by being pressed by the terminal. If the terminal is further pushed into the cavity, the locking lance is restored to lock the terminal, whereby the terminal is so held as not to come out from the connector housing.

With the retainer disposed at the full locking position, the retainer projects into the cavity to lock the terminal. In this way, the terminal is doubly locked while being retained.

CITATION LIST

[Patent Literature]

Patent Literature 1: Japanese Unexamined Patent Publication No. 2003-51352

SUMMARY OF INVENTION

Technical Problem

An operation of assembling a plurality of terminals to a connector housing may be performed over a plurality of times. In this case, if a retainer is kept at a partial locking position until all the terminals are inserted into the connector housing, an external force may be applied to a wire to disengage the terminal and a locking lance and the terminal may come out from the connector housing. To suppress this, it is thought to be preferable to move the retainer from the partial locking position to a full locking position and doubly lock the terminals every time a terminal inserting operation is performed.

However, since it is cumbersome to move the retainer between the partial locking position and the full locking position every time the terminal inserting operation is performed, it has been required to improve the efficiency of a terminal assembling operation.

The technique disclosed in this specification was completed on the basis of the above situation and aims to provide a technique for improving work efficiency in an operation of assembling a terminal to a connector.

Solution to Problem

The technique disclosed in this specification is directed to a connector with a terminal connected to an end of a wire, a connector housing including a cavity into which the terminal is inserted along a terminal inserting direction, and a retainer to be mounted into the connector housing and movable along a retainer moving direction intersecting the terminal inserting direction between a partial locking position for allowing insertion of the terminal into the cavity and a full locking position for locking and retaining the terminal, the retainer including a cam pin projecting in a pin projecting direction intersecting the retainer moving direction and different from the terminal inserting direction, the retainer moving between the full locking position and the partial locking position by the cam pin being fit into a cam groove provided in a jig and moving in the cam groove.

The technique disclosed in this specification is directed to a jig for retainer for moving a retainer between a partial locking position and a full locking position for a connector with a terminal connected to an end of a wire, a connector housing including a cavity into which the terminal is inserted along a terminal inserting direction, and the retainer to be mounted into the connector housing, movable along a retainer moving direction intersecting the terminal inserting direction between the partial locking position for allowing insertion of the terminal into the cavity and the full locking position for locking and retaining the terminal and including a cam pin projecting in a pin projecting direction intersecting the retainer moving direction and different from the terminal inserting direction, the jig including a housing insertion hole into which the connector housing is inserted, and a cam groove provided in a side wall of the housing insertion hole, the cam pin being fit into the cam groove, the retainer being moved to the full locking position with the cam pin located in a starting end part of the cam groove and being moved to the partial locking position with the cam pin located in a final end part of the cam groove.

According to the above configurations, the retainer can be moved to the partial locking position by moving the cam pin of the retainer to the final end part of the cam groove provided in the jig. In this state, the terminal connected to the end of the wire is inserted into the cavity of the connector housing. Thereafter, the retainer is moved to the full locking position by moving the cam pin of the retainer to the starting end part of the cam groove. In this way, the terminal can be retained and held in the connector housing by the retainer.

The technique disclosed in this specification is directed to a method for assembling a terminal to a connector, the method including assembling a retainer movable along a retainer moving direction intersecting a terminal inserting direction between a partial locking position for allowing insertion of a terminal into a cavity and a full locking position for locking and retaining the terminal with a connector housing including the cavity into which the terminal is inserted along the terminal inserting direction, inserting the connector housing into a housing insertion hole of a jig provided with the housing insertion hole into which the connector housing is insertable, and arranging a cam pin provided on the retainer and projecting in a pin projecting direction intersecting the retainer moving direction and different from the terminal inserting direction in a starting end part of a cam groove provided in a side wall of the housing insertion hole, moving the cam pin to a final end part of the cam groove and moving the retainer to the partial locking position by pushing the connector housing into the housing insertion hole, inserting the terminal connected to an end of a wire into the cavity along the terminal inserting direction, and moving the cam pin to the starting end part of the cam groove and moving the retainer to the full locking position by pulling the connector housing out of the housing insertion hole.

According to the above assembling method, the retainer can be easily moved to the partial locking position by inserting the connector housing into the housing insertion hole of the jig and moving the cam pin of the retainer to the final end part of the cam groove of the jig. In this way, the efficiency of an operation of assembling the terminal to the connector housing can be improved.

The cam pin is moved to the starting end part of the cam groove by pulling the connector housing out of the housing insertion hole after the terminal is inserted into the cavity. In this way, the retainer can be reliably moved to the full locking position. In this state, the terminal is retained and held in the connector housing by the retainer. Since the terminal can be retained and held in the connector housing by a simple operation of pulling the connector housing out of the jig as just described, the efficiency of the operation of assembling the terminal to the connector housing can be improved.

The following modes are preferable as embodiments of the technique disclosed in this specification.

An opening of the housing insertion hole is preferably located above a bottom part of the housing insertion hole with respect to gravity.

According to the above configuration, a front end part of the connector housing in an inserting direction is located below a rear end part with respect to gravity if the connector housing is inserted into the housing insertion hole. If the terminal is inserted into the cavity of the connector housing in this state, a front end part of the terminal is located below a rear end part with respect to gravity. As a result, the terminal is pulled downward by gravity due to the mass of the wire connected to the terminal even if a force is applied in such a direction that the terminal comes out of the cavity, wherefore it can be suppressed that the terminal comes out of the cavity.

A retaining portion for locking the connector housing inserted into the housing insertion hole is preferably provided in the opening of the housing insertion hole.

According to the above configuration, it can be suppressed that the connector housing comes out of the housing insertion hole during the operation of assembling the terminal to the connector housing. In this way, the efficiency of the operation of assembling the terminal to the connector housing can be improved.

[Effect]

According to the technique disclosed in this specification, it is possible to improve work efficiency in an operation of assembling a terminal to a connector.

EMBODIMENT OF INVENTION

Embodiment

One embodiment of the technique disclosed in this specification is described with reference to FIGS. 1 to 12. In the following description, it is assumed that a Z direction is an upward direction, a Y-direction is a forward direction and an X-direction is a leftward direction. The above directions are used for the convenience of the description of the embodiment and the Z direction may not necessarily coincide with a direction of gravity. Only some of a plurality of identical members may be denoted by a reference sign and the other members may not be denoted by the reference sign.

(Female Connector 10)

Figure 12:
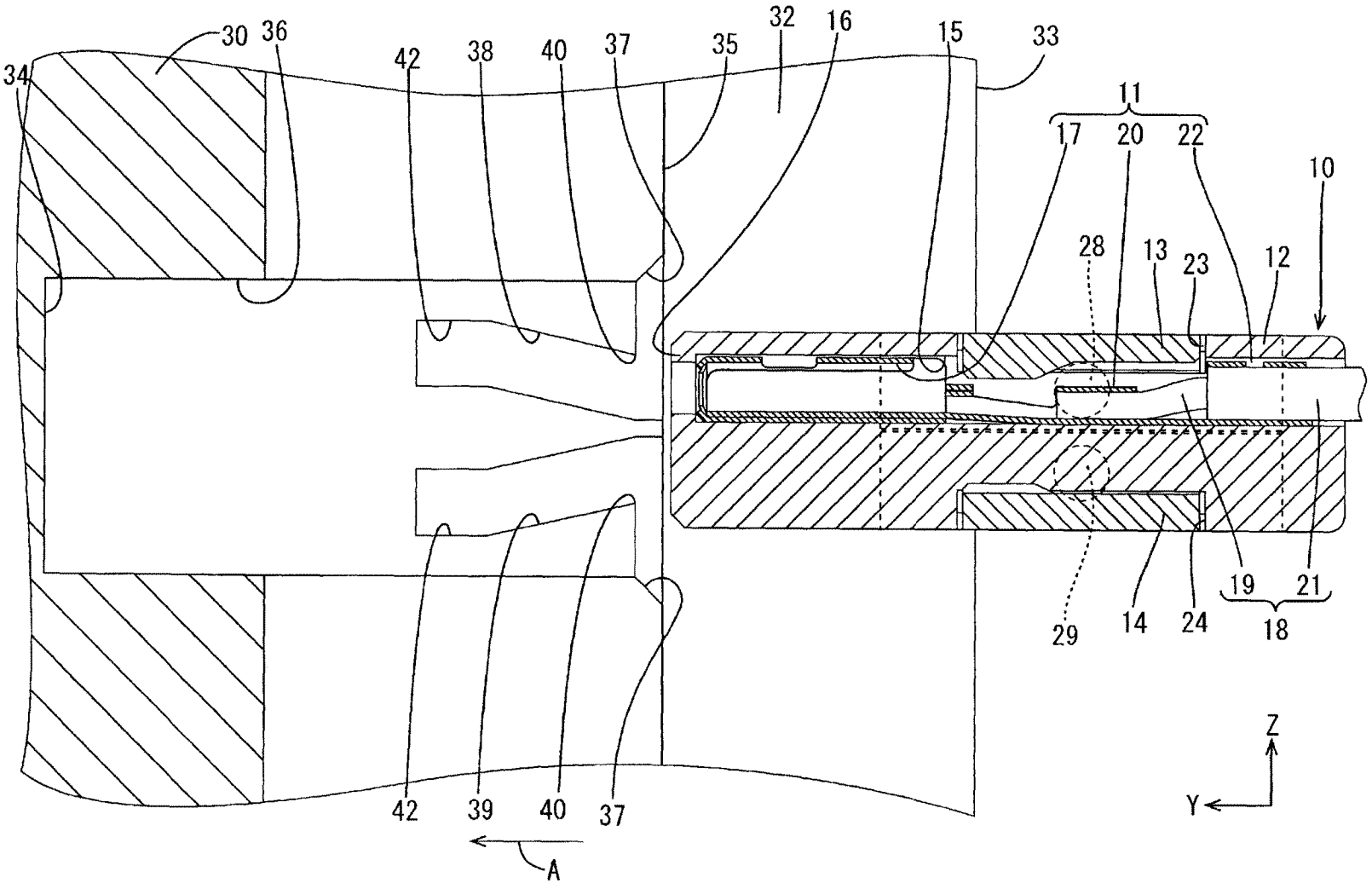
FIG. 12 is a partial enlarged section showing a state where a female connector in which the female terminal connected to the end of the wire is inserted in the cavity of the connector housing is pulled out of the jig.

As shown in FIG. 12, a female connector 10 (an example of a connector) according to this embodiment includes female terminals 11 (an example of a terminal), a connector housing 12 for accommodating the female terminals 11, and an upper retainer 13 (an example of a retainer) an a lower retainer 14 (an example of the retainer) to be mounted into the connector housing 12.

(Connector Housing 12)

The connector housing 12 is formed by injection-molding an insulating synthetic resin. The connector housing 12 has a rectangular parallelepiped shape flat in a vertical direction. A plurality of cavities 15 into which the female terminals 11 are inserted are arranged in a lateral direction in two upper and lower stages. The cavities 15 are formed to extend along a front-rear direction. In this embodiment, the front-rear direction is a terminal inserting direction in which the female terminal 11 is inserted into the cavity 15.

Figure 1:
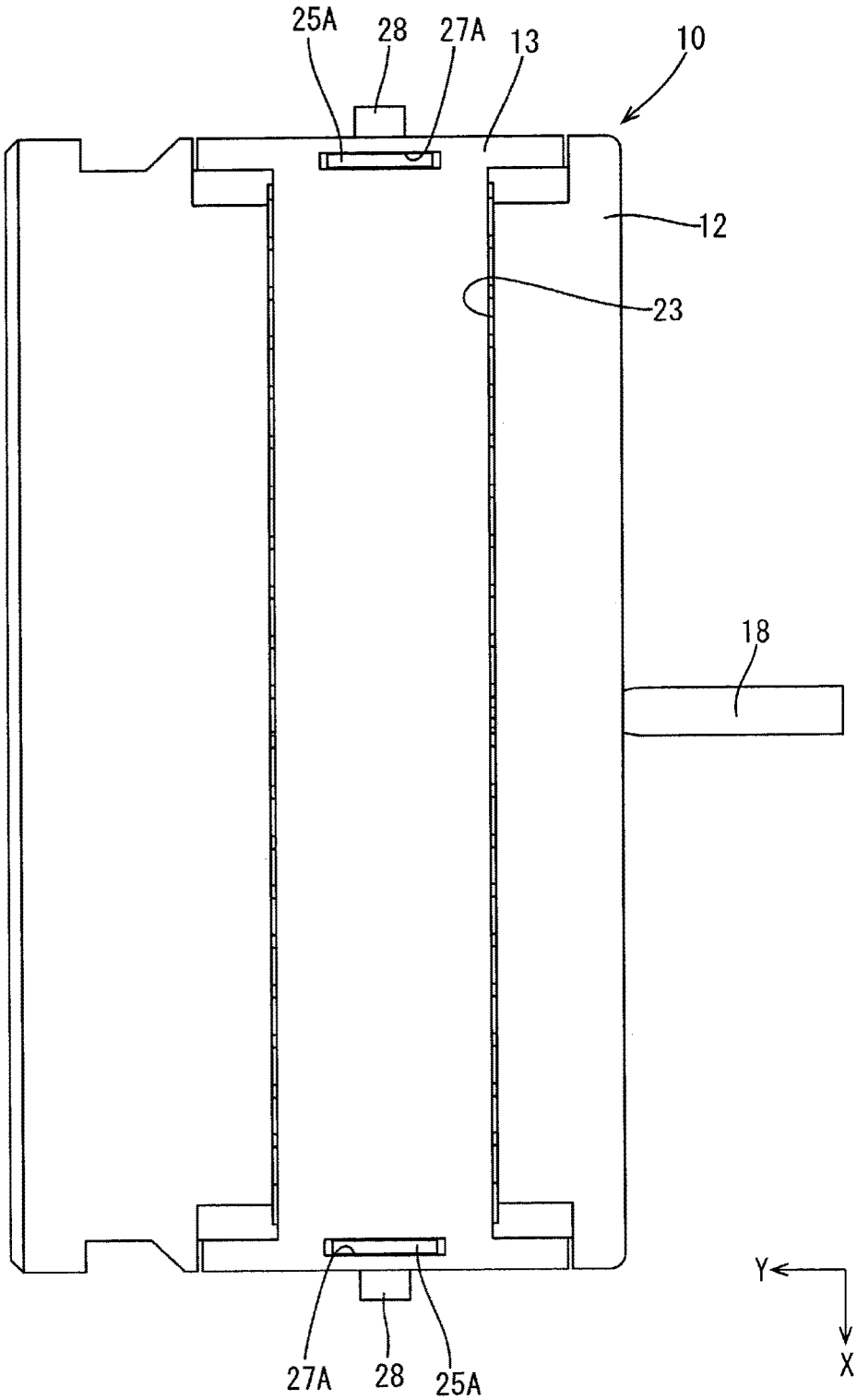
FIG. 1 is a plan view showing a state where an upper retainer and a lower retainer are held at partial locking positions in a connector according to one embodiment.
Figure 2:
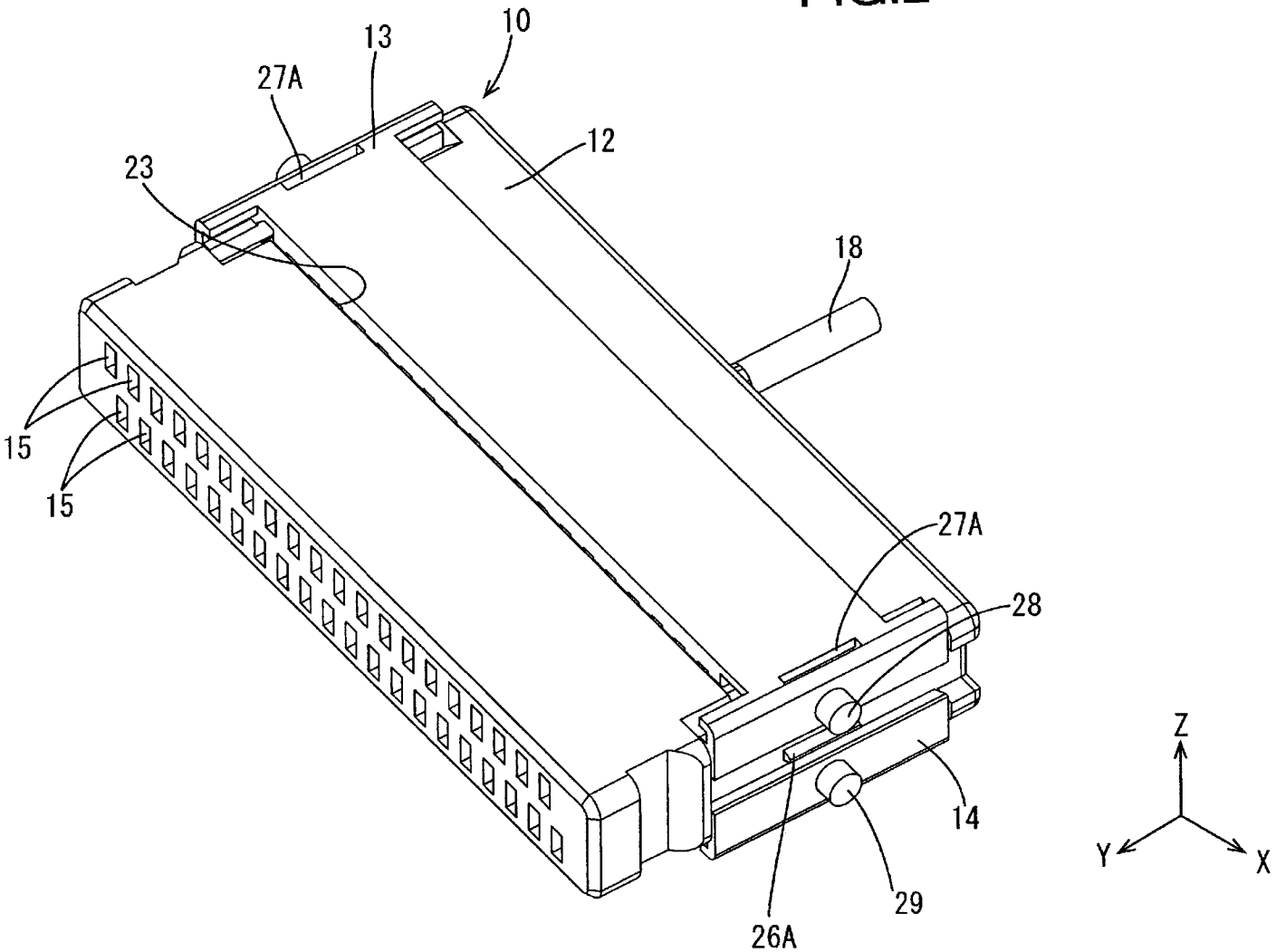
FIG. 2 is a perspective view showing the state where the upper and lower retainers are held at the partial locking positions.
Figure 3:
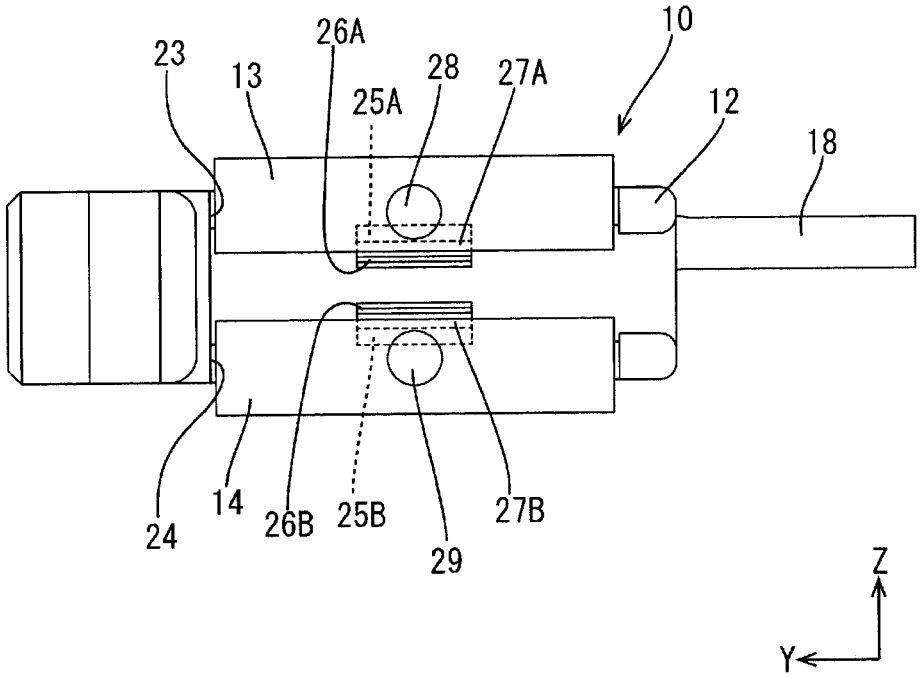
FIG. 3 is a side view showing the state where the upper and lower retainers are held at the partial locking positions.
Figure 4:
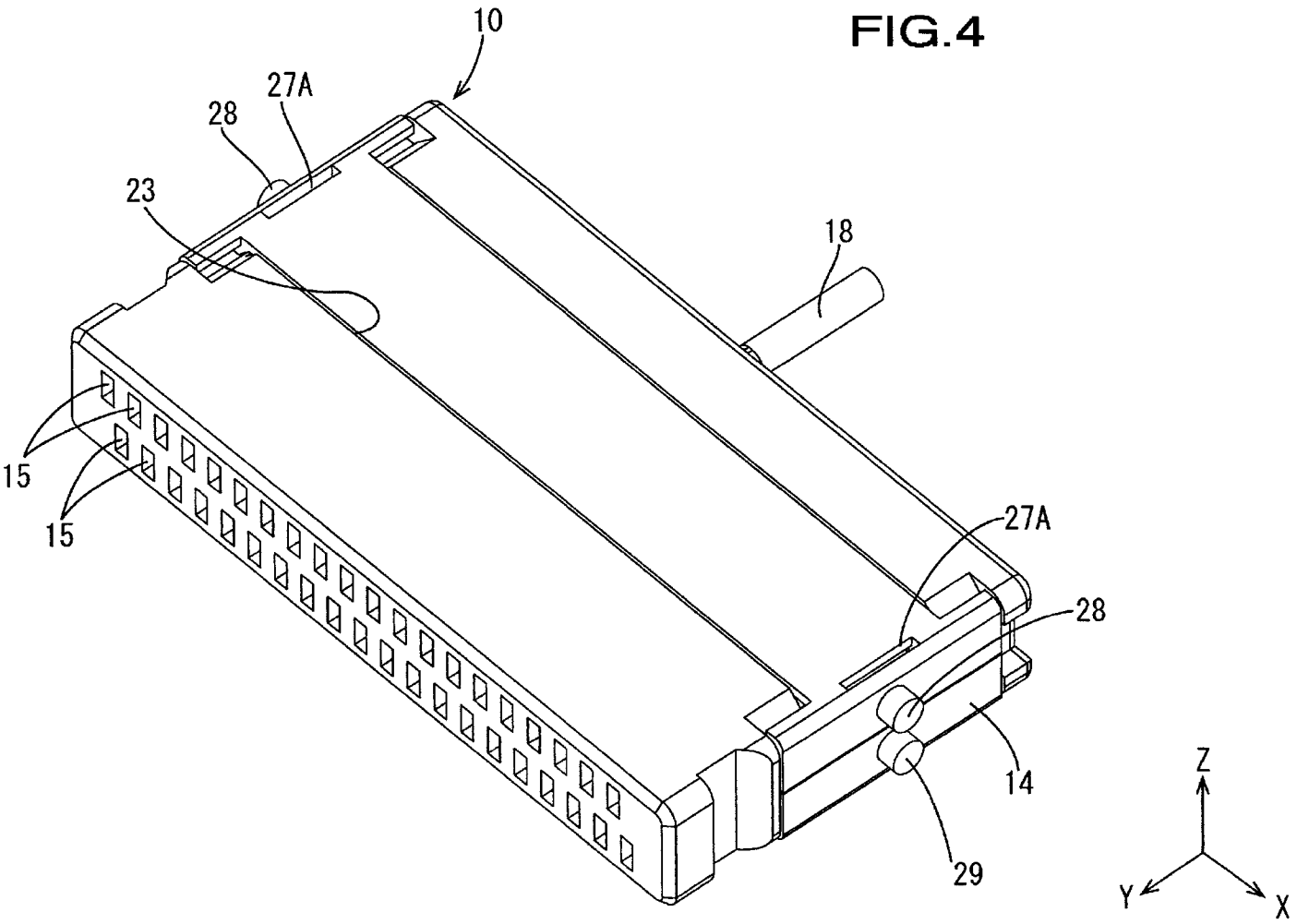
FIG. 4 is a perspective view showing a state where the upper and lower retainers are held at full locking positions.
Figure 5:
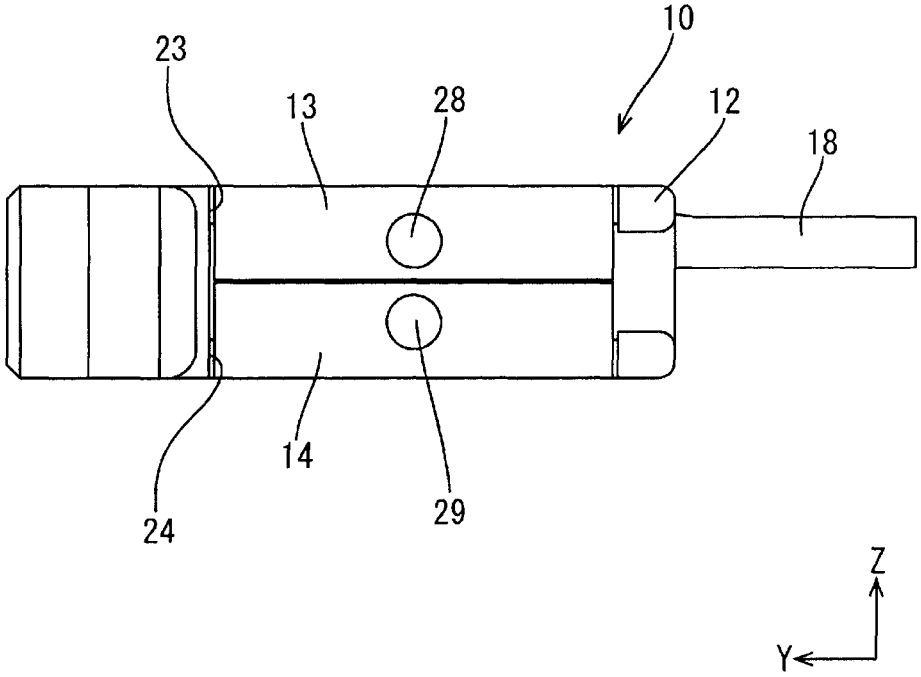
FIG. 5 is a side view showing the where the upper and lower retainers are held at the full locking positions.

As shown in FIG. 4, the respective cavities 15 formed in the upper stage and those formed in the lower stage are disposed at positions shifted in the lateral direction. Note that the number of the plurality of cavities 15 is arbitrary, and the plurality of cavities 15 may be formed side by side in one stage or three or more stages in the vertical direction. Each cavity 15 is open forward in a front end part of the connector housing 12 and open rearward in a rear end part of the connector housing 12. A front end edge of a connecting tube portion 17 of the female terminal 11 to be described later comes into contact with a front wall 16 of the cavity 15 from behind, whereby the female terminal 11 is stopped in front.

In this embodiment, a locking lance for retaining and locking the female terminal 11 is not provided inside the cavity 15. Thus, in inserting the female terminal 11 into the cavity 15, the female terminal 11 does not receive any resilient force from the locking lance due to the contact of the locking lance and the female terminal 11.

(Female Terminals 11)

Figure 8:
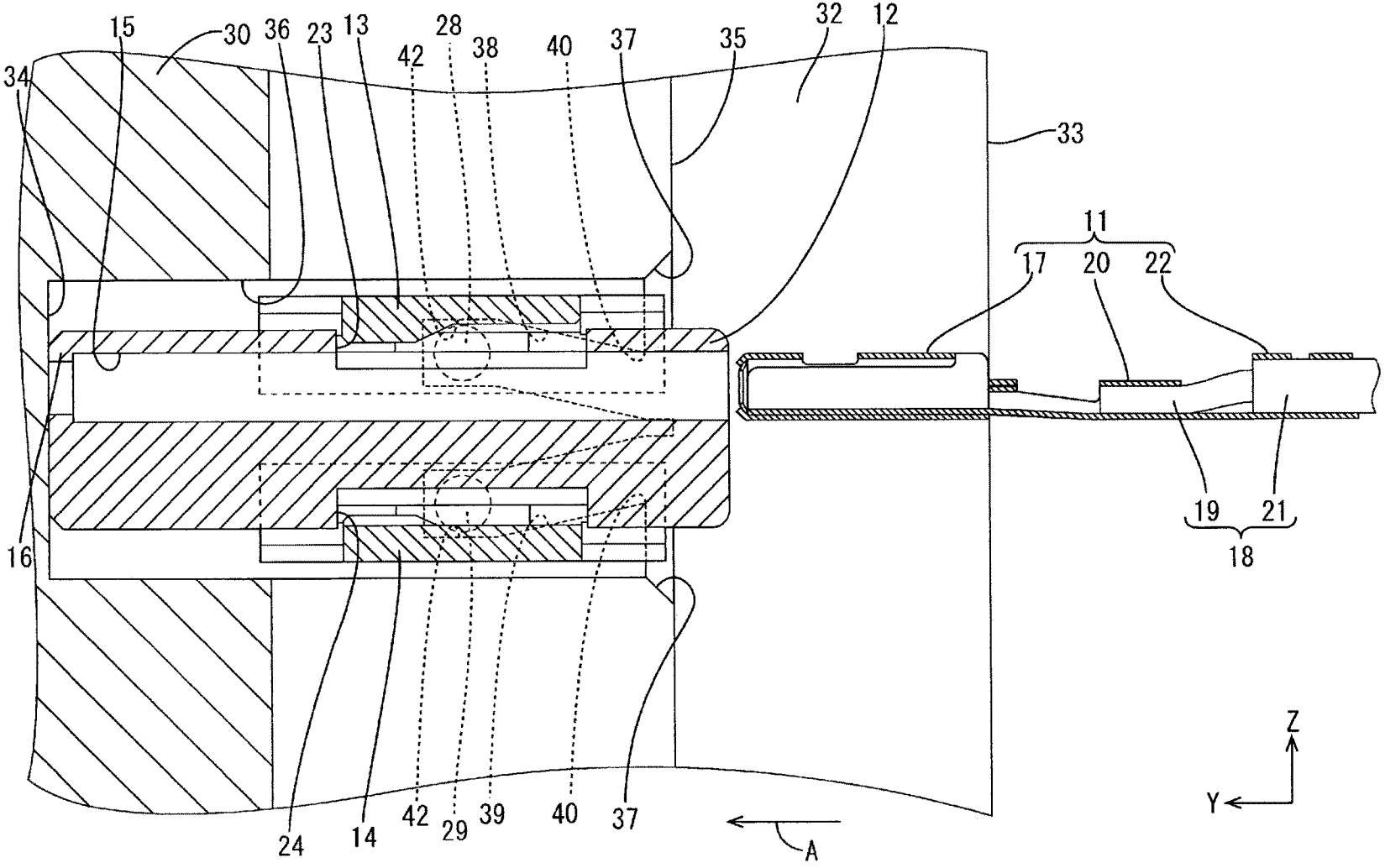
FIG. 8 is a partial enlarged section showing a state before a female terminal is inserted into a cavity with the upper and lower retainers held at the partial locking positions.

As shown in FIG. 8, the female terminal 11 is formed by press-working a metal plate material into a predetermined shape. An arbitrary metal such as copper, copper alloy, aluminum or aluminum alloy can be selected according to need as a metal constituting the female terminal 11. The female terminal 11 according to this embodiment is made of copper or copper alloy. A plating layer is formed on a surface of a terminal body. An arbitrary metal such as tin or nickel can be selected according to need as a metal for forming the plating layer. A tin plating layer is formed on the surface of the female terminal 11 in this embodiment.

The female terminal 11 includes the connecting tube portion 17 into which an unillustrated male terminal is inserted. The connecting tube portion 17 is in the form of a rectangular tube. A resilient contact piece (not shown) configured to resiliently contact the inserted male terminal is disposed inside the connecting tube portion 17. A wire barrel 20 to be crimped to a core 19 of a wire 18 is formed behind the connecting tube portion 17. An insulation barrel 22 to be crimped to an insulation coating surrounding the outer periphery of the core 19 is formed behind the wire barrel 20.

(Retainer)

As shown in FIGS. 1 to 5, an upper opening 23 communicating with the cavities 15 in the upper stage is formed in the upper surface of the connector housing 12, and a lower opening 24 communicating with the cavities 15 in the lower stage is formed in the lower surface of the connector housing 12. The upper retainer 13 is mounted into the upper opening 23 to close this upper opening 23, and the lower retainer 14 is mounted into the lower opening 24 to close this lower opening 24.

A partial locking portion 25A for locking the upper retainer 13 at a partial locking position and a full locking portion 26A located at a position below the partial locking portion 25A for locking the upper retainer 13 at a full locking position are formed to project laterally outward on each side wall of the connector housing 12. Lock receiving portions 27A to be resiliently locked to these partial locking portions 25A and full locking position 26A are provided on both left and right parts of the upper retainer 13.

Further, a partial locking portion 25B for locking the lower retainer 14 at a partial locking position and a full locking portion 26B located at a position above the partial locking portion 25B for locking the lower retainer 14 at a full locking position are formed to project laterally outward on each side wall of the connector housing 12. Lock receiving portions 27B to be resiliently locked to these partial locking portions 25B and full locking position 26B are provided on both left and right parts of the lower retainer 14.

As described above, each of the upper and lower retainers 13, 14 is movable along the vertical direction between the full locking position and the partial locking position. In this embodiment, the vertical direction is a retainer moving direction. The retainer moving direction is set to a direction intersecting the terminal inserting direction. In this embodiment, the retainer moving direction (vertical direction) is set to a direction perpendicular to the terminal inserting direction (front-rear direction).

Upper cam pins 28 projecting laterally outward are formed on the outer surfaces of the side walls of the upper retainer 13. The upper cam pins 28 have a circular cross-sectional shape. Lower cam pins 29 projecting laterally outward are formed on the outer surfaces of the side walls of the lower retainer 14. The lower cam pins 29 have a circular cross-sectional shape. In this embodiment, the lateral direction is a pin projecting direction in which the cam pins project. The pin projecting direction is set to a direction intersecting the retainer moving direction and different from the terminal inserting direction.

(Jig 30)

Figure 6:
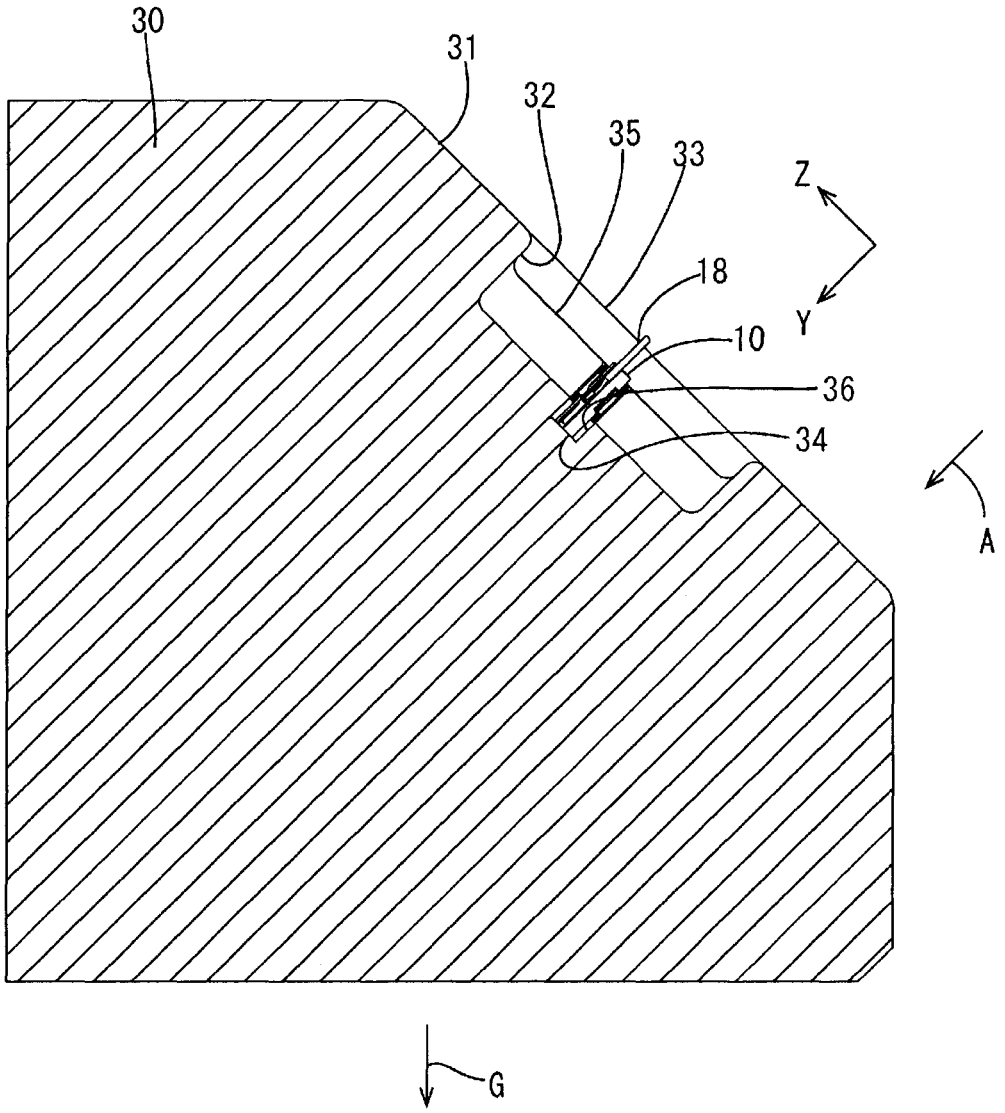
FIG. 6 is a section showing a jig.
Figure 10:
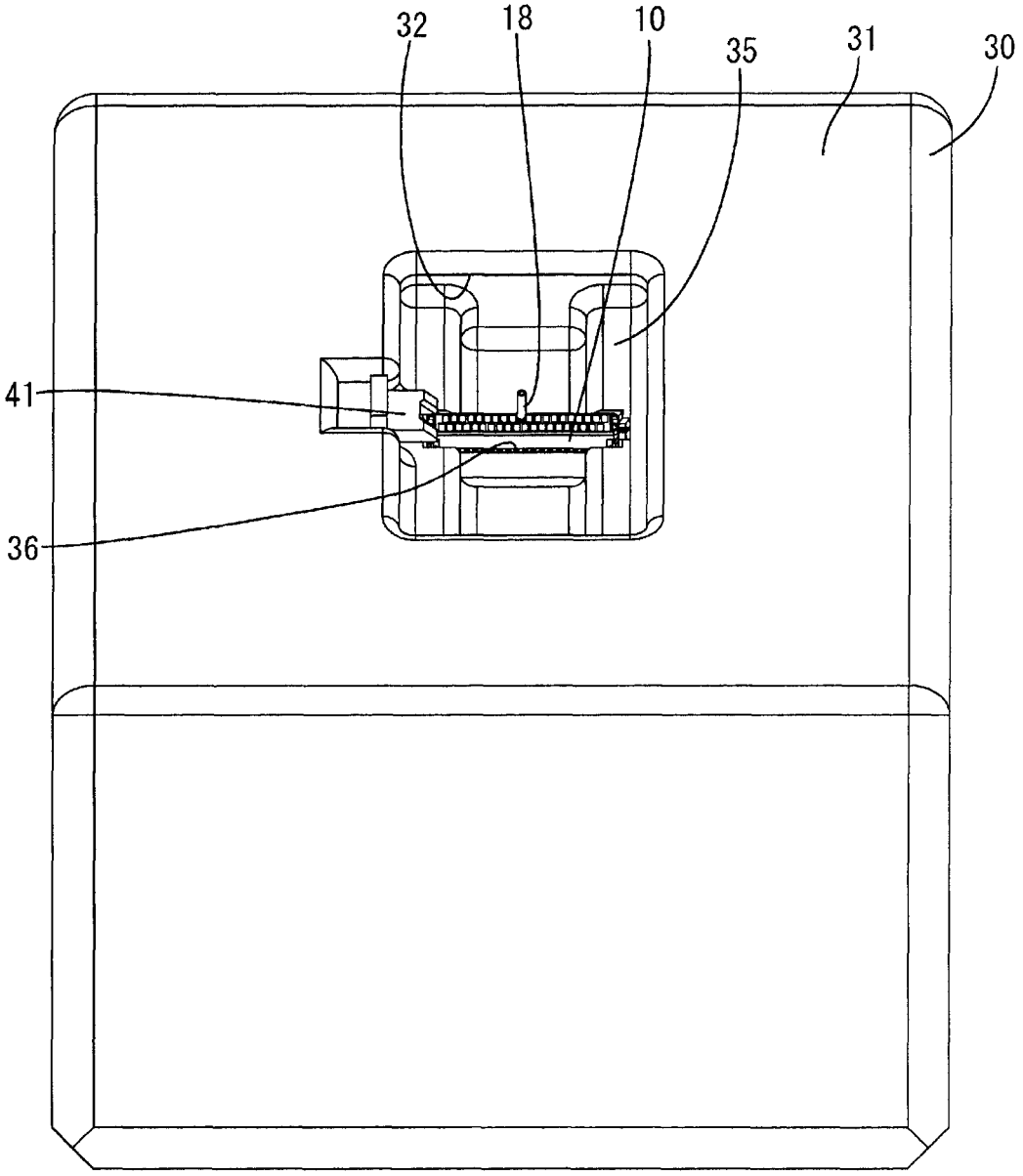
FIG. 10 is a back view showing a state where the connector housing is inserted in the housing insertion hole of the jig and the female terminal connected to an end of a wire is inserted in the cavity of the connector housing.

As shown in FIGS. 6 and 10, the jig 30 has such a shape substantially obtained by cutting one ridge of a rectangular parallelepiped to form an inclined surface inclined with respect to the vertical direction. This inclined surface serves as a work surface 31 for performing an assembling process of the female connector 10. The work surface 31 is recessed to form a housing insertion hole 32 for accommodating the female connector 10. The housing insertion hole 32 is recessed in a direction indicated by an arrow A. The female connector 10 is inserted into the housing insertion hole 32 along the direction indicated by this arrow A, and the direction indicated by the arrow A serves as a connector inserting direction.

With the jig 30 placed, an opening 33 of the housing insertion hole 32 is located above a bottom part 34 of the housing insertion hole 32 with respect to the vertical direction G, which is a direction of gravity. In this embodiment, an extending direction (direction indicated by the arrow A) of the housing insertion hole 32 is set to a direction inclined obliquely downward with respect to the vertical direction G.

Figure 11:
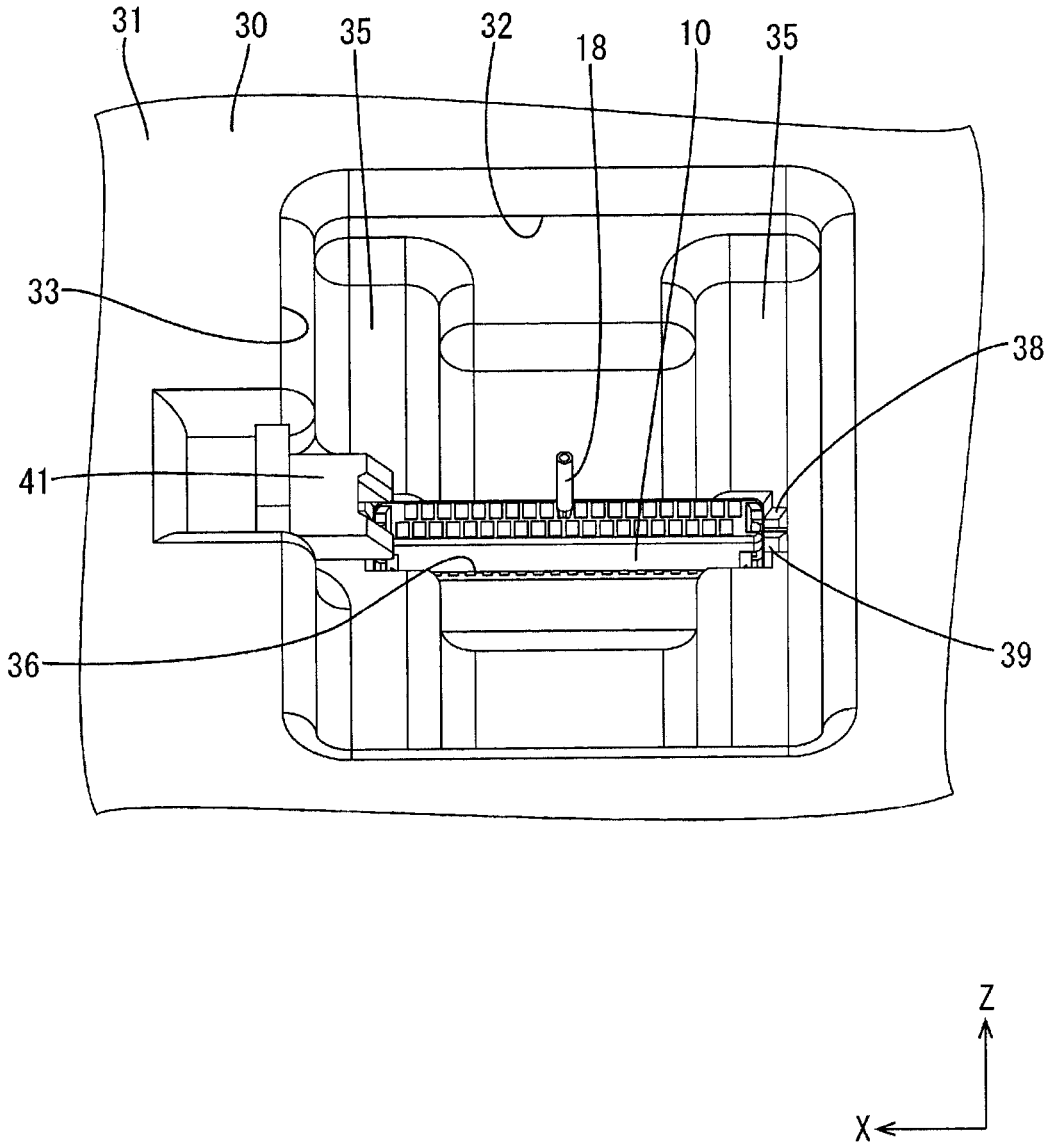
FIG. 11 is a partial enlarged back view of FIG. 10.

As shown in FIGS. 10 and 11, the housing insertion hole 32 includes a work recess 35 having a substantially rectangular shape when viewed from above and relatively shallowly recessed, and a connector holding recess 36 formed near a vertical center of the work recess 35 and deeply recessed. A cross-sectional shape of the connector holding recess 36 is set to be the same as or somewhat larger than that of the female connector 10. Guiding slopes 37 expanded toward a rear side with respect to the connector inserting direction are provided in a boundary part between the work recess 35 and the connector holding recess 36 (see FIG. 7). The female connector 10 can be easily inserted into the connector holding recess 36 by being guided by these guiding slopes 37.

As shown in FIG. 8, a front end part of the female connector 10 comes into contact with the bottom part 34 of the housing insertion hole 32 from front, whereby a forward movement of the female connector 10 is suppressed.

Figure 7:
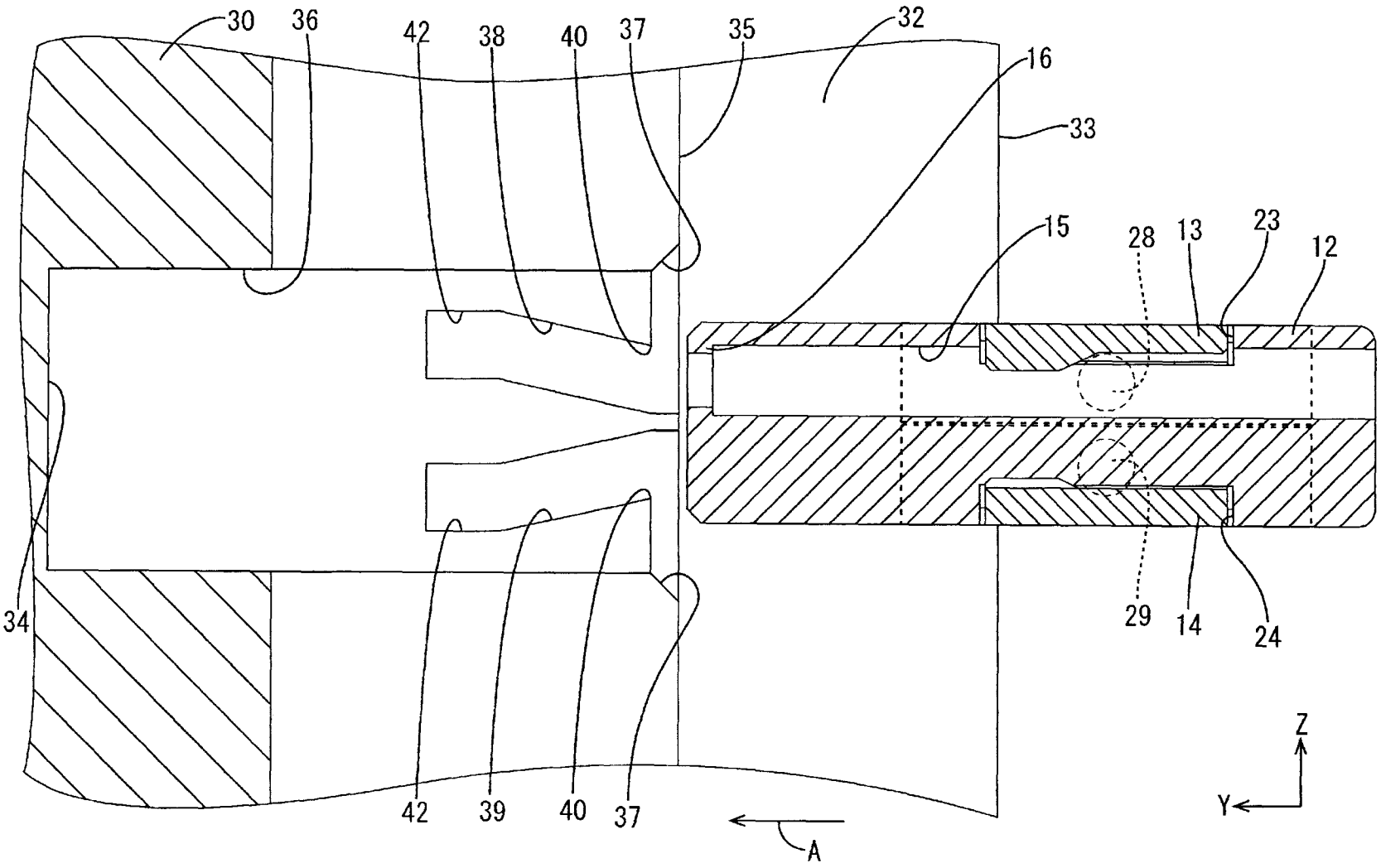
FIG. 7 is a partial enlarged section showing a state before a connector housing is inserted into a housing insertion hole of the jig.

As shown in FIGS. 7 and 11, an upper cam groove 38 to be fit to the upper cam pin 28 and a lower cam groove 39 to be fit the lower cam pin 29 are provided in each of both left and right side walls of the housing insertion hole 32.

The upper cam groove 38 and the lower cam groove 39 include starting end parts 40 open rearward toward the work surface 31 with respect to the connector inserting direction when viewed laterally, and are formed to extend forward with respect to the connector inserting direction. The upper and lower cam grooves 38, 39 have bent shapes to be separated from each other toward the front in the connector inserting direction.

With the female connector 10 inserted in the housing insertion hole 32 from behind in the connector inserting direction and the upper and lower cam pins 28, 29 respectively fit in the starting end parts 40 of the upper cam grooves 38 and the starting end parts 40 of the lower cam grooves 39, the upper and lower retainers 13, 14 are held at the full locking positions with respect to the connector housing 12.

If the female connector 10 is pushed forward with respect to the connector inserting direction, the upper and lower cam pins 28, 29 respectively move along the connector inserting direction in the upper and lower cam grooves 38, 39. Since the upper and lower cam grooves 38, 39 have the bent shapes to be separated from each other toward the front in the connector inserting direction, the upper and lower cam pins 28, 29 are separated as the female connector 10 moves forward with respect to the connector inserting direction. With the female connector 10 moved further forward with respect to the connector inserting direction and the upper and lower cam pins 28, 29 respectively moved to final end parts 42 of the upper and lower cam grooves 38, 39, the upper and lower retainers 13, 14 are moved to the partial locking positions with respect to the connector housing 12 (see FIG. 8).

With the upper and lower retainers 13, 14 held at the partial locking positions with respect to the connector housing 12, the upper and lower retainers 13, 14 are disposed at positions separated from the female terminals 11 even if the female terminals 11 are accommodated in the cavities 15 of the connector housing 12.

As shown in FIG. 11, a retaining portion 41 for retaining the female connector 10 by coming into contact with the female connector 10 from behind in the extending direction of the housing insertion hole 32 with the female connector 10 inserted in the housing insertion hole 32 is provided on a left end part of the opening 33 of the housing insertion hole 32. The retaining portion 41 is formed to be resiliently deformable in the lateral direction. If the female connector 10 is inserted into the housing insertion hole 32, the retaining portion 41 is resiliently deformed by coming into contact with an outer surface of the connector housing 12. The retaining portion 41 is restored by further pushing the female connector 10 into the housing insertion hole 32, and the female connector 10 is retained and held by the contact of the retaining portion 41 with the connector housing 12.

(Assembling Process of Female Connector 10)

Next, an example of an assembling process of the female connector 10 is described.

As shown in FIG. 7, the upper and lower retainers 13, 14 are assembled with the connector housing 12 and held at the full locking positions.

The connector housing 12 is accommodated into the housing insertion hole 32 of the jig 30 from behind in the connector inserting direction. Then, the upper cam pins 28 are fit into the starting end parts 40 of the upper cam grooves 38 and the lower cam pins 29 are fit into the starting end parts 40 of the lower cam grooves 39.

If the connector housing 12 is pushed further forward with respect to the connector inserting direction, the upper cam pins 28 move in the upper cam grooves 38 and the lower cam pins 29 move in the lower cam grooves 39 as the connector housing 12 moves forward with respect to the connector inserting direction. Then, forces acting in directions separating from each other are applied to the upper and lower retainers 13, 14 from the upper and lower cam pins 28, 29. In this way, the full locking portions 26A of the upper retainer 13 and the lock receiving portions 27A of the connector housing 12 are disengaged, and the full locking portions 26B of the lower retainer 14 and the lock receiving portions 27B of the connector housing 12 are disengaged.

As shown in FIG. 8, the front end part of the connector housing 12 comes into contact with the bottom part 34 of the housing insertion hole 32 from front, whereby an inserting process of the connector housing 12 into the housing insertion hole 32 is finished. In this state, the upper cam pins 28 have moved to the final end parts 42 of the upper cam grooves 38 and the lower cam pins 29 have moved to the final end parts 42 of the lower cam grooves 39. At this time, the partial locking portions 25A of the upper retainer 13 are engaged with the lock receiving portions 27A of the connector housing 12, and the partial locking portions 25B of the lower retainer 14 are engaged with the lock receiving portions 27B of the connector housing 12. In this way, the upper and lower retainers 13, 14 are held at the partial locking positions with respect to the connector housing 12.

Subsequently, the female terminal 11 is inserted into the cavity 15 of the connector housing 12 from behind in the terminal inserting direction. With the upper and lower retainers 13, 14 held at the partial locking positions, the upper and lower retainers 13, 14 are separated from the female terminal 11. In this way, the female terminal 11 is allowed to be inserted into the cavity 15. By pushing the female terminal 11 into the cavity 15, the female terminal 11 moves forward in the cavity 15.

Figure 9:
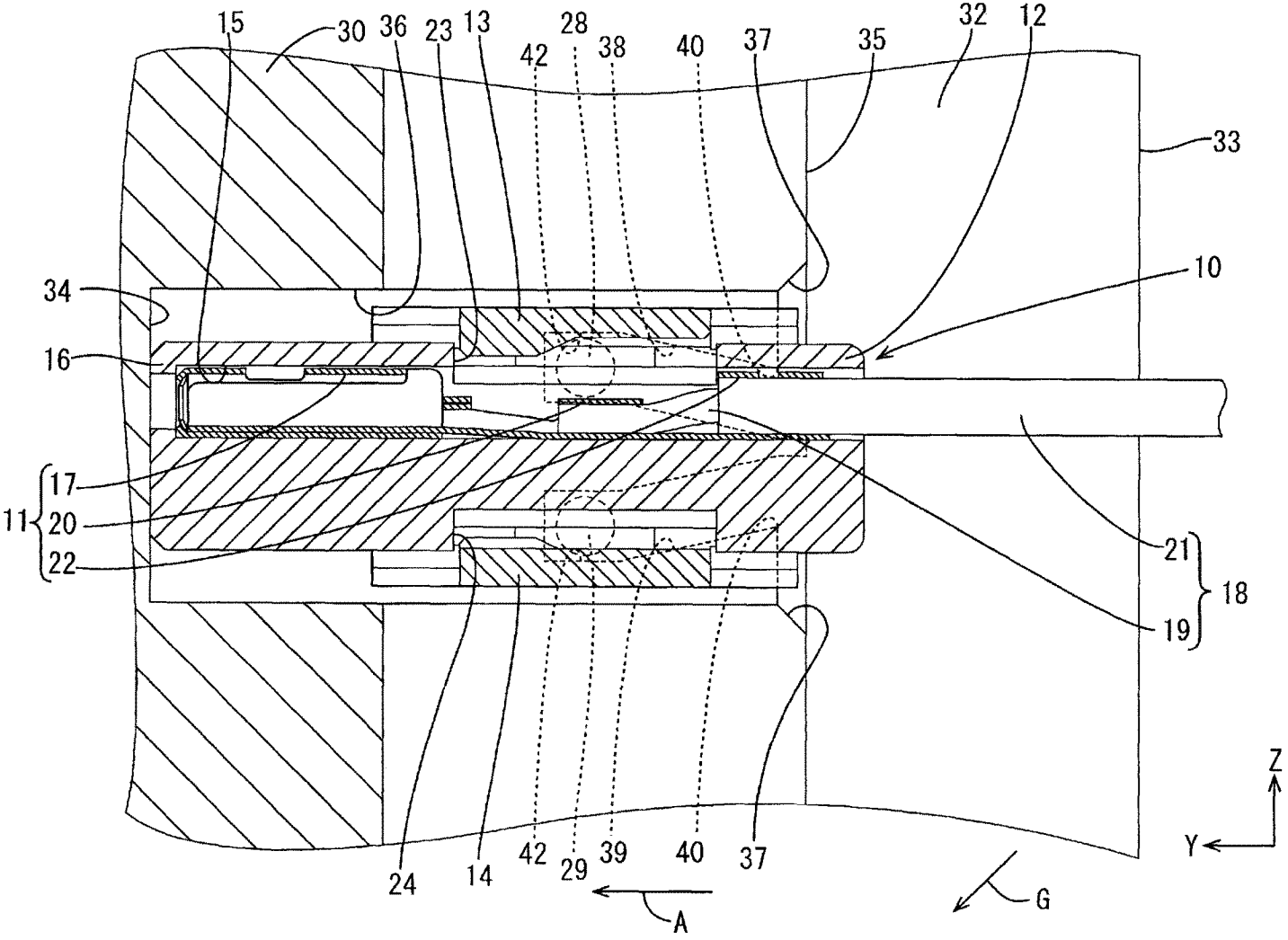
FIG. 9 is a partial enlarged section showing a state where the female terminal is inserted in the cavity with the upper and lower retainers held at the partial locking positions.

A front end part of the female terminal 11 comes into contact with the front wall 16 of the cavity 15 of the connector housing 12, whereby the female terminal 11 is stopped in front and held in the cavity 15 (see FIG. 9).

As shown in FIG. 9, the inserting direction of the female terminal 11 into the cavity 15 is oriented to be inclined with respect to the gravity related vertical direction G. In this way, even if the wire 18 is pulled to apply a force in such a direction as to pull the female terminal 11 from the connector housing 12, the female terminal 11 is not easily pulled out from the connector housing 11 by being pulled downward by gravity.

Subsequently, the connector housing 12 is pulled rearward with respect to the connector inserting direction. Then, the upper cam pins 28 move rearward with respect to the connector inserting direction in the upper cam grooves 38, and the lower cam pins 29 move rearward with respect to the connector inserting direction in the lower cam grooves 39. In this way, the upper and lower retainers 13, 14 receive forces acting in directions toward each other. As a result, the partial locking portions 25A of the upper retainer 13 and the lock receiving portions 27A of the connector housing 12 are disengaged, and the partial locking portions 25B of the lower retainer 14 and the lock receiving portions 27B of the connector housing 12 are disengaged.

By further pulling the connector housing 12 rearward with respect to the connector inserting direction, the upper cam pins 28 move to the starting end parts 40 of the upper cam grooves 38 and the lower cam pins 29 move to the starting end parts 40 of the lower cam grooves 39. In this way, the full locking portions 26A of the upper retainer 13 and the lock receiving portions 27A of the connector housing 12 are engaged, and the full locking portions 26B of the lower retainer 14 and the lock receiving portions 27B of the connector housing 12 are engaged. In this way, the upper retainer 13 comes into contact with the connecting tube portions 17 of the female terminals 11 accommodated in the cavities 15 in the upper stage from behind in the terminal inserting direction, and the lower retainer 14 comes into contact with the connecting tube portions 17 of the female terminals 11 accommodated in the cavities 15 in the lower stage from behind in the terminal inserting direction, whereby the female terminals 11 are retained in the connector housing 12.

As shown in FIG. 12, with the connector housing 12 pulled out of the jig 30, the female terminals 11 accommodated in the connector housing 12 are retained and held by the upper and lower retainers 13, 14 held at the full locking positions. The female connector 10 is completed in the above way.

(Functions and Effects of Embodiment)

Next, functions and effects of this embodiment are described. The female connector 10 according to this embodiment is provided with the female terminals 11 connected to the ends of the wires 18, the connector housing 12 including the cavities 15 into which the female terminals 11 are inserted along the terminal inserting direction, and the upper and lower retainers 13, 14 to be mounted into the connector housing 12 and movable along the retainer moving direction intersecting the terminal inserting direction between the partial locking positions for allowing the insertion of the terminals into the cavities 15 and the full locking positions for locking and retaining the terminals. The upper and lower retainers 13, 14 include the upper and lower cam pins 28, 29 projecting in the pin projecting direction intersecting the retainer moving direction and different from the terminal inserting direction, and the upper and lower cam pins 28, 29 are fit into the upper and lower cam grooves 38, 39 provided in the jig 30 and move in the upper and lower cam grooves 39, 39, whereby the upper and lower retainers 13, 14 move between the full locking positions and the partial locking positions.

Further, the jig 30 according to this embodiment is for moving the upper and lower retainers 13, 14 between the partial locking positions and the full locking positions for the female connector 10 with the female terminals 11 connected to the ends of the wires 18, the connector housing 12 including the cavities 15 into which the female terminals 11 are inserted along the terminal inserting direction, and the upper and lower retainers 13, 14 to be mounted into the connector housing 12, movable along the retainer moving direction intersecting the terminal inserting direction between the partial locking positions for allowing the insertion of the terminals into the cavities 15 and the full locking positions for locking and retaining the terminals and including the upper and lower cam pins 28, 29 projecting in the pin projecting direction intersecting the retainer moving direction and different from the terminal inserting direction. The jig 30 includes the housing insertion hole 32 into which the connector housing 12 is inserted, the upper and lower cam grooves 38, 39 into which the upper and lower cam pins 28, 29 are fit are provided in the side walls of the housing insertion hole 32, the upper and lower retainers 13, 14 are moved to the full locking positions with the upper and lower cam pins 28, 29 located in the starting end parts 40 of the upper and lower cam grooves 38, 39 and the upper and lower retainers 13, 14 are moved to the partial locking positions with the upper and lower cam pins 28, 29 located in the final end parts 42 of the upper and lower cam grooves 38, 39.

According to the above configurations, the upper and lower retainers 13, 14 can be moved to the partial locking positions by moving the upper and lower cam pins 28, 29 of the upper and lower retainers 13, 14 to the final end parts 42 of the upper and lower cam grooves 38, 39 provided in the jig 30. In this state, the female terminals 11 connected to the ends of the wires 18 are inserted into the cavities 15 of the connector housing 12. Since the female terminal 11 is allowed to be inserted into the cavity 15 at the partial locking position, it is suppressed that a force is applied to the wire 18 via the female terminal 11 from the inner wall of the cavity 15 when the female terminal 11 is inserted into the cavity 15. Specifically, since no locking lance is provided in the cavity 15, the female terminal 11 receives no resilient force from the locking lance. In this way, the buckling of the wire 18 is suppressed. Thereafter, the upper and lower retainers 13, 14 are moved to the full locking positions by moving the upper and lower cam pins 28, 29 of the upper and lower retainers 13, 14 to the starting end parts 40 of the upper and lower cam grooves 38, 39. In this way, the female terminals 11 can be retained and held in the connector housing 12 by the upper and lower retainers 13, 14.

Further, according to this embodiment, the opening 33 of the housing insertion hole 32 is located above the bottom part 34 of the housing insertion hole 32 with respect to gravity.

According to the above configuration, if the connector housing 12 is inserted into the housing insertion hole 32, the front end part of the connector housing 12 in the connector inserting direction is located below the rear end part with respect to gravity. If the female terminal 11 is inserted into the cavity 15 of the connector housing 12 in this state, the front end part of the female terminal 11 is located below the rear end part with respect to gravity. As a result, even if a force is applied to the wire 18 connected to the female terminal 11 in such a direction that the female terminal 11 comes out of the cavity 15, it can be suppressed that the female terminal 11 comes out of the cavity 15 since the female terminal 11 is pulled downward by gravity.

Further, according to this embodiment, the retaining portion 41 for locking the connector housing 12 inserted into the housing insertion hole 32 is provided in the opening 33 of the housing insertion hole 32.

According to the above configuration, it can be suppressed that the connector housing 12 comes out of the housing insertion hole 32 during an operation of assembling the female terminals 11 to the connector housing 12. In this way, the efficiency of the operation of assembling the female terminals 11 to the connector housing 12 can be improved.

Further, a method according to this embodiment for assembling the female terminals 11 to the connector includes assembling the upper and lower retainers 13, 14 movable along the retainer moving direction intersecting the terminal inserting direction between the partial locking positions for allowing the insertion of the female terminals 11 into the cavities 15 and the full locking positions for locking and retaining the female terminals 11 with the connector housing 12 including the cavities 15 into which the female terminals 11 are inserted along the terminal inserting direction, inserting the connector housing 12 into the housing insertion hole 32 of the jig 30 provided with the housing insertion hole 32 into which the connector housing 12 is insertable, arranging the upper and lower cam pins 28, 29 provided on the upper and lower retainers 13, 14 and projecting in the pin projecting direction intersecting the retainer moving direction and different from the terminal inserting direction in the starting end parts 40 of the upper and lower cam grooves 38, 39 provided in the side walls of the housing insertion hole 32, moving the upper and lower retainers 13, 14 to the partial locking positions by moving the upper and lower cam pins 28, 29 to the final end parts 42 of the upper and lower cam grooves 38, 39, inserting the female terminals 11 connected to the ends of the wires 18 into the cavities 15 along the terminal inserting direction, and moving the upper and lower cam pins 28, 29 to the starting end parts 40 of the upper and lower cam grooves 38, 39 and moving the upper and lower retainers 13, 14 to the full locking positions by pulling the connector housing 12 out of the housing insertion hole 32.

According to the above assembling method, the upper and lower retainers 13, 14 can be easily moved to the partial locking positions by inserting the connector housing 12 into the housing insertion hole 32 of the jig 30 and moving the upper and lower cam pins 28, 29 of the upper and lower retainers 13, 14 to the final end parts 42 of the upper and lower cam grooves 38, 39 of the jig 30. In this way, the efficiency of the operation of assembling the female terminals 11 to the connector housing 12 can be improved.

Since the female terminal 11 can be inserted into the cavity 15 with the upper and lower retainers 13, 14 moved to the partial locking positions, it is suppressed that a force is applied to the wire 18 connected to the female terminal 11. As a result, the buckling of the wire 18 is suppressed.

By pulling the connector housing 12 out of the housing insertion hole 32 after the female terminals 11 are inserted into the cavities 15, the upper and lower cam pins 28, 29 are moved to the starting end parts 40 of the upper and lower cam grooves 38, 39. In this way, the upper and lower retainers 13, 14 can be reliably moved to the full locking positions. In this state, the female terminals 11 are retained and held in the connector housing 12 by the upper and lower retainers 13, 14. Since the female terminals 11 can be retained and held in the connector housing 12 by a simple operation of pulling the connector housing 12 out of the jig 30 as just described, the efficiency of the operation of assembling the female terminals 11 to the connector housing 12 can be improved.

Other Embodiments

The technique disclosed in this specification is not limited to the above described and illustrated embodiment. For example, the following embodiments are also included in the technical scope of the technique disclosed in this specification.

(1) Although the female terminals 11 are accommodated into the female connector 10 in the above embodiment, there is no limitation to this and male terminals may be accommodated into a male connector.

(2) Although the cavities 15 are provided in two upper and lower stages in the connector housing 12 according to the above embodiment, there is no limitation to this and the cavities 15 may be arranged in one stage or three or more stages.

(3) The retaining portion 41 for retaining the connector housing 12 may be omitted.

(4) Although the housing insertion hole 32 extends obliquely downward with respect to gravity, there is no limitation to this and a housing insertion hole may extend vertically downward. Further, a housing insertion hole may extend horizontally with respect to gravity.

(5) Although the connector housing 12 is provided with no locking lance in the above embodiment, there is no limitation to this and locking lances may be provided in the cavities 15 of the connector housing 12 and the female terminals 11 may be retained and held in the connector housing 12 by the engagement of these locking lances and the female terminals 11. In this way, the female terminals 11 can be doubly locked by the locking lances and the upper and lower retainers 13, 14 disposed at the full locking positions.

LIST OF REFERENCE SIGNS

10: female connector
11: female terminal
12: connector housing
13: upper retainer
14: lower retainer
15: cavity
18: wire
28: upper cam pin
29: lower cam pin
30: jig
32: housing insertion hole
33: opening
34: bottom part
38: upper cam groove
39: lower cam groove
40: starting end part
41: retaining portion
42: final end part

The invention claimed is:

1. A connector, comprising:

a terminal connected to an end of a wire;

a connector housing including a cavity into which the terminal is inserted along a terminal inserting direction; and a retainer to be mounted into the connector housing and movable along a retainer moving direction intersecting the terminal inserting direction between a partial locking position for allowing insertion of the terminal into the cavity and a full locking position for locking and retaining the terminal in the cavity, the retainer including a cam pin projecting in a pin projecting direction intersecting the retainer moving direction and different from the terminal inserting direction, the retainer moving between the full locking position and the partial locking position by the cam pin being fit into a cam groove provided in a jig and moving in the cam groove, wherein no locking lance for retaining and locking the terminal is provided inside the cavity.

2. A jig for moving a retainer between a partial locking position and a full locking position for a connector with a terminal connected to an end of a wire, a connector housing including a cavity into which the terminal is inserted along a terminal inserting direction, and the retainer to be mounted into the connector housing, movable along a retainer moving direction intersecting the terminal inserting direction between the partial locking position for allowing insertion of the terminal into the cavity and the full locking position for locking and retaining the terminal in the cavity and including a cam pin projecting in a pin projecting direction intersecting the retainer moving direction and different from the terminal inserting direction, the jig comprising:

a housing insertion hole into which the connector housing is inserted; and a cam groove provided in a side wall of the housing insertion hole, the cam pin being fit into the cam groove, the retainer being moved to the full locking position with the cam pin located in a starting end part of the cam groove and being moved to the partial locking position with the cam pin located in a final end part of the cam groove.

3. The jig of claim 2, wherein an opening of the housing insertion hole is located above a bottom part of the housing insertion hole with respect to gravity.

4. The jig of claim 2, wherein a retaining portion for locking the connector housing inserted into the housing insertion hole is provided in an opening of the housing insertion hole.

5. A method for assembling a terminal to a connector, comprising:

assembling a retainer movable along a retainer moving direction intersecting a terminal inserting direction between a partial locking position for allowing insertion of a terminal into a cavity and a full locking position for locking and retaining the terminal in the cavity with a connector housing including the cavity into which the terminal is inserted along the terminal inserting direction;

inserting the connector housing into a housing insertion hole of a jig provided with the housing insertion hole into which the connector housing is insertable, and arranging a cam pin provided on the retainer and projecting in a pin projecting direction intersecting the retainer moving direction and different from the terminal inserting direction in a starting end part of a cam groove provided in a side wall of the housing insertion hole;

moving the cam pin to a final end part of the cam groove and moving the retainer to the partial locking position by pushing the connector housing into the housing insertion hole;

inserting the terminal connected to an end of a wire into the cavity along the terminal inserting direction; and moving the cam pin to the starting end part of the cam groove and moving the retainer to the full locking position by pulling the connector housing out of the housing insertion hole.

* * * * *